US011224907B2

(12) United States Patent
Nozaki et al.

(10) Patent No.: US 11,224,907 B2
(45) Date of Patent: Jan. 18, 2022

(54) COMPOSITE ROLL FOR ROLLING AND ITS PRODUCTION METHOD

(71) Applicant: HITACHI METALS, LTD., Tokyo (JP)

(72) Inventors: Yasunori Nozaki, Kitakyusyu (JP); Nozomu Oda, Kitakyusyu (JP); Toshiyuki Hattori, Kitakyusyu (JP)

(73) Assignee: HITACHI METALS, LTD., Tokyo (JP)

( * ) Notice: Subject to any disclaimer, the term of this patent is extended or adjusted under 35 U.S.C. 154(b) by 139 days.

(21) Appl. No.: 16/481,208

(22) PCT Filed: Feb. 8, 2018

(86) PCT No.: PCT/JP2018/004396

§ 371 (c)(1),
(2) Date: Jul. 26, 2019

(87) PCT Pub. No.: WO2018/147370

PCT Pub. Date: Aug. 16, 2018

(65) Prior Publication Data

US 2019/0366402 A1 Dec. 5, 2019

(30) Foreign Application Priority Data

Feb. 8, 2017 (JP) ..... JP2017-021118

(51) Int. Cl.
*B21B 27/00* (2006.01)
*B22D 13/02* (2006.01)
(Continued)

(52) U.S. Cl.
CPC ..... *B21B 27/00* (2013.01); *B22D 13/02* (2013.01); *B22D 19/16* (2013.01); *C22C 38/44* (2013.01);
(Continued)

(58) Field of Classification Search
CPC ..... B21B 27/00; B21B 27/032
See application file for complete search history.

(56) References Cited

U.S. PATENT DOCUMENTS 9,815,098 B2 * 11/2017 Hattori ..... B22D 13/026
2016/0207084 A1 7/2016 Hattori et al.

FOREIGN PATENT DOCUMENTS

JP 2002-088445 A 3/2002
JP 2002088445 A * 3/2002
(Continued)

OTHER PUBLICATIONS

Machine Translation of JP 2015 205342 (Year: 2015).*
(Continued)

*Primary Examiner* — Jacob J Cigna
(74) *Attorney, Agent, or Firm* — Sughrue Mion, PLLC

(57) ABSTRACT

A composite roll for rolling having a structure comprising centrifugally cast outer and intermediate layers of an Fe-based alloy integrally fused to an inner layer of ductile cast iron; the outer layer having a composition comprising by mass 1-3% of C, 0.3-3% of Si, 0.1-3% of Mn, 0.5-5% of Ni, 1-7% of Cr, 2.2-8% of Mo, 4-7% of V, 0.005-0.15% of N, and 0.05-0.2% of B, the balance being Fe and inevitable impurities; the intermediate layer containing 0.025-0.15% by mass of B; the B content in the intermediate layer being 40-80% of that in the outer layer; and the total amount of Cr, Mo, V, Nb and W in the intermediate layer being 40-90% of that in the outer layer.

4 Claims, 3 Drawing Sheets

(51) Int. Cl.

| | |
|---|---|
| ***B22D 19/16*** | (2006.01) |
| ***C22C 38/44*** | (2006.01) |
| ***C22C 38/48*** | (2006.01) |
| ***C22C 38/56*** | (2006.01) |
| ***C22C 38/58*** | (2006.01) |

(52) U.S. Cl.
CPC ..... *C22C 38/48* (2013.01); *C22C 38/56* (2013.01); *C22C 38/58* (2013.01)

(56) References Cited

FOREIGN PATENT DOCUMENTS

| | | | | |
|---|---|---|---|---|
| JP | 3458357 | B2 | | 10/2003 |
| JP | 2005-264322 | A | | 9/2005 |
| JP | 2007029968 | A | * | 2/2007 |
| JP | 2015-205342 | A | | 11/2015 |
| JP | 2015205342 | A | * | 11/2015 |
| WO | 2015/045985 | A1 | | 4/2015 |

OTHER PUBLICATIONS

Machine Translation of JP 2002 088445 (Year: 2002).*
International Search Report for PCT/JP2018/004396 dated Apr. 10, 2018 [PCT/ISA/210].

* cited by examiner

COMPOSITE ROLL FOR ROLLING AND ITS PRODUCTION METHOD

CROSS REFERENCE TO RELATED APPLICATIONS

This application is a National Stage of International Application No. PCT/JP2018/004396 filed Feb. 8, 2018, claiming priority based on Japanese Patent Application No. 2017-021118 filed Feb. 8, 2017.

FIELD OF THE INVENTION

The present invention relates to a composite roll for rolling comprising an outer layer and an inner layer well integrally fused to each other, which has excellent wear resistance, sticking resistance and surface roughening resistance, and is suitably used in rear stands likely suffering seizure in mills for hot-finishing a thin strip, stands for differential-speed-rolling shaped steel, etc.

BACKGROUND OF THE INVENTION

A heated slab as thick as several hundreds of millimeters, which is produced by continuous casting, etc., is rolled to thickness of several to several tens of millimeters by a hot strip mill comprising a roughing mill and a finishing mill. The finishing mill usually comprises 5 to 7 four-roll stands arranged in tandem. In the case of a seven-stand finishing mill, first to third stands are called "front stands," and fourth to seventh stands are called "rear stands." A working roll used in such a hot strip mill comprises an outer layer coming into contact with a hot thin strip, and an inner layer integrally fused to an inner surface of the outer layer, and is produced by casting a melt for the inner layer after forming the outer layer by a centrifugal casting method.

Because of higher requirements for the improved thickness precision and surface quality of hot-rolled steel strips in recent years, rolling rolls having high wear resistance have been required, and high-speed steel rolls have become practically used in front stands of hot-finishing mills for producing thin steel strips. However, highly alloyed grain cast iron rolls have conventionally been mainly used in rear stands of hot-finishing mills, which likely suffer so-called cobble in which a strip folded during moving between stands passes through upper and lower rolls.

Such coble makes a strip stuck to an outer layer surface of the roll, resulting in an excessive thermal and mechanical load applied to the outer layer surface of the roll, thereby likely causing cracking. If the use of the cracked roll continues, cracks propagate, likely causing damage such as breakage and spalling of the roll. Because the cobble (sudden mill stop) necessitates the grinding of the roll surface to remove cracks, deep cracking would lead to large roll loss, resulting in higher roll cost. The removal of cracks from the roll surface by grinding is called "damage-removing grinding." Accordingly, a rolling outer layer with excellent sticking resistance for less damage by cracking even in rolling troubles, and a rolling composite roll having such outer layer are desired.

To meet such requirement, JP 2005-264322 A discloses an outer layer of a hot-rolling roll having excellent sticking resistance, which has a composition comprising by mass 1.8-3.5% of C, 0.2-2% of Si, 0.2-2% of Mn, 4-15% of Cr, 2-10% of Mo, 3-10% of V, 0.1-0.6% of P, and 0.05-0.5% of B, the balance being Fe and inevitable impurities. JP 2005-264322 A describes that with a roll composition containing proper amounts of P and B, a low-melting-point eutectic compound phase is formed, so that the hot-rolling roll has remarkably improved sticking resistance, without deteriorating wear resistance and surface roughening resistance. JP 2005-264322 A also describes that an intermediate layer of graphite steel or high-carbon steel may be formed between an outer layer having the above composition and an inner layer of spheroidal graphite cast iron, etc. However, it has been found that shrinkage voids are likely generated near a boundary when the centrifugally cast outer layer is resolidified after the intermediate layer melt is poured and bonded to the outer layer.

WO 2015/045985 A discloses a centrifugally cast, hot-rolling composite roll, in which an outer layer has a chemical composition comprising by mass 1.6-3% of C, 0.3-2.5% of Si, 0.3-2.5% of Mn, 0.1-5% of Ni, 2.8-7% of Cr, 1.8-6% of Mo, 3.3-6.5% of V, and 0.02-0.12% of B, the balance being Fe and inevitable impurities, meeting the relation expressed by the formula (1) of $Cr/(Mo+0.5W) \geq -2/3[C-0.2(V+1.19Nb)]+11/6$, wherein W=0, and Nb=0 when W and Nb, optional components, are not contained, and contains by area 1-15% of MC carbides, 0.5-20% of carboborides, and 1-25% of Cr carbides. This composite roll exhibits good wear resistance, sticking resistance and surface roughening resistance, because of excellent sticking resistance by the lubrication of carboborides formed by adding B. In the production of the rolling composite roll of WO 2015/045985 A, to prevent microcavity defects in a boundary when an inner layer melt is cast inside the outer layer, the reheating temperature of the outer layer at least within an effective rolling diameter is controlled to 500-1100° C. It has been found, however, that it is difficult to control production steps for satisfying the reheating temperature of the outer layer within an effective rolling diameter when the inner layer melt is cast.

Japanese Patent 3458357 discloses a composite roll comprising an outer layer of wear-resistant cast iron, an intermediate layer fused to an inner surface of the outer layer, and an inner layer fused to an inner surface of the intermediate layer; the outer and intermediate layers being centrifugally cast; the outer layer having a chemical composition comprising by weight 1.0-3.0% of C, 0.1-2.0% of Si, 0.1-2.0% of Mn, 0.1-4.5% of Ni, 3.0-10.0% of Cr, 0.1-9.0% of Mo, 1.5-10.0% of W, 3.0-10.0% in total of one or two of V and Nb, 0.5-10.0% of Co, and 0.01-0.50% of B, the balance being substantially Fe, and having a Young's modulus of 21000-23000 kgf/mm$^2$; the intermediate layer having a chemical composition comprising by weight 1.0-2.5% of C, 0.2-3.0% of Si, 0.2-1.5% of Mn, 4.0% or less of Ni, 4.0% or less of Cr, 4.0% or less of Mo, and 12% or less in total of W, V, Nb and B, the balance being substantially Fe and Co coming from the outer layer, and having a thickness of 25-30 mm, a Young's modulus of 20000-23000 kgf/mm$^2$; and the inner layer being formed by flake graphite cast iron, spheroidal graphite cast iron or graphite steel. This composite roll with an outer layer formed by special cast iron having a particular chemical composition exhibits drastically improved wear resistance, because of high-hardness composite carbides of MC, $M_7C_3$, $M_6C$, $M_2C$ types, etc. It has been found, however, that the composite roll described in Japanese Patent 3458357 is likely to suffer shrinkage voids near a boundary when the centrifugally cast outer layer is resolidified after coming into contact with the poured intermediate layer melt.

OBJECT OF THE INVENTION

Accordingly, an object of the present invention is to provide a composite roll for rolling having excellent wear resistance, sticking resistance and surface roughening resistance, in which an outer layer is well integrally fused to an inner layer, and its production method.

DISCLOSURE OF THE INVENTION

As a result of intensive research on a composite roll for rolling comprising an outer layer of an Fe-based alloy having wear resistance, sticking resistance and surface roughening resistance, and an inner layer of ductile cast iron, the inventors have found that in the formation of an intermediate layer between the outer layer and the inner layer to prevent shrinkage voids from being generated in a boundary between them, the control of the casting temperature of a melt for the intermediate layer and the inner surface temperature of the outer layer can prevent shrinkage voids between the outer layer and the intermediate layer, providing an integrally fused (metallurgically bonded) composite roll. The present invention has been completed based on such finding.

The composite roll for rolling according to the present invention has a structure comprising centrifugally cast outer and intermediate layers of an Fe-based alloy, and an inner layer of ductile cast iron, which are integrally fused to each other;

the outer layer having a composition comprising by mass 1-3% of C, 0.3-3% of Si, 0.1-3% of Mn, 0.5-5% of Ni, 1-7% of Cr, 2.2-8% of Mo, 4-7% of V, 0.005-0.15% of N, and 0.05-0.2% of B, the balance being Fe and inevitable impurities;

the intermediate layer containing 0.025-0.15% by mass of B;

the amount of B in the intermediate layer being 40-80% of that in the outer layer; and the total amount of carbide-forming elements in the intermediate layer being 40-90% of that in the outer layer.

The outer layer preferably further contains 0.1-3% by mass of Nb and/or 0.1-5% by mass of W.

The outer layer preferably further contains at least one selected from the group consisting of 0.1-10% of Co, 0.01-0.5% of Zr, 0.005-0.5% of Ti, and 0.001-0.5% of Al by mass.

The method of the present invention for producing the above composite roll for rolling comprises (1) centrifugally casting the outer layer in a rotating cylindrical centrifugal-casting mold;

(2) pouring a melt for an intermediate layer at a temperature equal to or higher than the solidification start temperature of the intermediate layer +110° C. into a cavity of the outer layer, while the inner surface temperature of the outer layer is equal to or higher than the solidification completion temperature of the outer layer melt, thereby centrifugally casting the intermediate layer; and (3) pouring a ductile cast iron melt for an inner layer into a cavity of the intermediate layer after the solidification of the intermediate layer, thereby forming the inner layer.

Effects of the Invention

The rolling composite roll of the present invention can be obtained by properly controlling (a) the composition of an intermediate layer formed between the outer layer and the inner layer, and (b) the inner surface temperature of the outer layer when the intermediate layer melt is cast, as well as the temperature of the intermediate layer melt, and has good bonding in any boundary between the outer layer, the intermediate layer and the inner layer, thereby preventing shrinkage voids near their boundaries, particularly near the boundary between the outer layer and the intermediate layer, as well as excellent wear resistance, sticking resistance and surface roughening resistance.

BRIEF DESCRIPTION OF THE DRAWINGS

FIG. 3(*b*) is a cross-sectional view showing an example of casting molds used for producing the rolling composite roll of the present invention.

DESCRIPTION OF THE PREFERRED EMBODIMENTS

The embodiments of the present invention will be explained in detail below without intention of restriction, and various modifications may be made within the scope of the present invention. Unless otherwise mentioned, what is simply described as "%" means "% by mass."

[1] Composite Roll for Rolling

Figure 1:
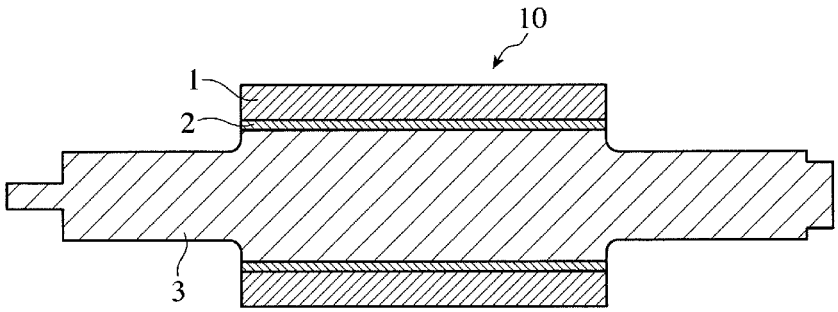
FIG. 1 is a schematic cross-sectional view showing the rolling composite roll of the present invention.

As shown in FIG. 1, the rolling composite roll of the present invention comprises a centrifugally cast outer layer 1 of an Fe-based alloy, an intermediate layer 2 of an Fe-based alloy centrifugally cast inside the outer layer 1, and an inner layer 3 statically cast inside the intermediate layer 2.

(A) Outer Layer

The centrifugally cast outer layer of an Fe-based alloy has a composition comprising by mass 1-3% of C, 0.3-3% of Si, 0.1-3% of Mn, 0.5-5% of Ni, 1-7% of Cr, 2.2-8% of Mo, 4-7% of V, and 0.005-0.15% of N, 0.05-0.2% of B, the balance being substantially Fe and inevitable impurities. The outer layer may further contain 0.1-3% by mass of Nb and/or 0.1-5% by mass of W. The outer layer may further contain at least one selected from the group consisting of 0.1-10% of Co, 0.01-0.5% of Zr, 0.005-0.5% of Ti, and 0.001-0.5% of Al by mass.

(1) Indispensable Elements (a) C: 1-3% by Mass

C is combined with V, Cr and Mo (and Nb and/or W if contained) to form hard carbides, contributing to improvement in the wear resistance of the outer layer. When C is less than 1% by mass, too small amounts of hard carbides are formed, failing to provide the outer layer with sufficient wear resistance. On the other hand, when C exceeds 3% by mass, excessive carbides are formed, providing the outer layer with low toughness and decreased cracking resistance, thereby resulting in deep cracks by rolling, and thus large loss of the roll by damage-removing grinding. The lower limit of the C content is preferably 1.5% by mass, more preferably 1.7% by mass. The upper limit of the C content is preferably 2.9% by mass, more preferably 2.8% by mass.

(b) Si: 0.3-3% by Mass

Si deoxidizing the melt to reduce defects by oxides is dissolved in the matrix to improve sticking resistance, and further increases the fluidity of the melt to prevent casting defects. Less than 0.3% by mass of Si provides the melt with insufficient deoxidization and fluidity, resulting in a higher percentage of defects. On the other hand, when Si exceeds 3% by mass, the alloy matrix becomes brittle, providing the outer layer with low toughness. The lower limit of the Si content is preferably 0.4% by mass, more preferably 0.5% by mass. The upper limit of the Si content is preferably 2.7% by mass, more preferably 2.5% by mass.

(c) Mn: 0.1-3% by Mass

Mn has functions of not only deoxidizing the melt, but also fixing S as MnS. Because MnS exhibiting lubrication effectively prevents the seizure of a rolled strip, it is preferable to contain a desired amount of MnS. When Mn is less than 0.1% by mass, its effects are insufficient. On the other hand, more than 3% by mass of Mn does not provide further effects. The lower limit of the Mn content is preferably 0.3% by mass. The upper limit of the Mn content is preferably 2.4% by mass, more preferably 1.8% by mass.

(d) Ni: 0.5-5% by Mass

Because Ni has a function of increasing the hardenability of the matrix, Ni can prevent the generation of pearlite during cooling when added to a large composite roll, increasing the hardness of the outer layer. Less than 0.5% by mass of Ni fails to exhibit sufficient effects, while more than 5% by mass of Ni stabilizes austenite too much, hardly improving the hardness. The lower limit of the Ni content is preferably 1.0% by mass, more preferably 1.5% by mass, further preferably 2.0% by mass. The upper limit of the Ni content is preferably 4.5% by mass, more preferably 4.0% by mass, further preferably 3.5% by mass.

(e) Cr: 1-7% by Mass

Cr is an element effective for making the matrix bainite or martensite to keep hardness, thereby maintaining wear resistance. Less than 1% by mass of Cr exhibits insufficient effects, while more than 7% by mass of Cr decreases the toughness of the matrix. The lower limit of the Cr content is preferably 1.5% by mass, more preferably 2.5% by mass. The upper limit of the Cr content is preferably 6.8% by mass.

(f) Mo: 2.2-8% by Mass

Mo is combined with C to form hard carbides ($M_6C$, $M_2C$), increasing the hardness of the outer layer, and improving the hardenability of the matrix. When Mo is less than 2.2% by mass, its effects are insufficient particularly in the formation of hard carbides. On the other hand, more than 8% by mass of Mo lowers the toughness of the outer layer. The lower limit of the Mo content is preferably 2.4% by mass, more preferably 2.6% by mass. The upper limit of the Mo content is preferably 7.8% by mass, more preferably 7.6% by mass.

(g) V: 4-7% by Mass

V is an element combined with C to form hard MC carbides. The MC carbides have Vickers hardness HV of 2500-3000, hardest among carbides. Less than 4% by mass of V provides insufficient effects. On the other hand, when V exceeds 7% by mass, MC carbides having low specific gravity are concentrated in an inner side of the outer layer by a centrifugal force during centrifugal casting, resulting in extreme radial segregation of MC carbides, and forming large MC carbides making the alloy structure coarser, which likely causes surface roughening during rolling. The lower limit of the V content is preferably 4.1% by mass, more preferably 4.2% by mass. The upper limit of the V content is preferably 6.9% by mass, more preferably 6.8% by mass.

(h) N: 0.005-0.15% by Mass

N is effective to make carbides finer, but it makes the outer layer brittle when it exceeds 0.15% by mass. The upper limit of the N content is preferably 0.1% by mass. To achieve a sufficient effect of making carbides finer, the lower limit of the N content is 0.005% by mass, preferably 0.01% by mass.

(i) B: 0.05-0.2% by Mass

B is not only dissolved in carbides, but also forms lubricating carboborides, improving sticking resistance. The lubrication of carboborides is exhibited particularly at high temperatures, effectively preventing sticking when a hot-rolled strip is bitten by the rolls. Less than 0.05% by mass of B does not exhibit sufficient lubrication, while more than 0.2% by mass of B makes the outer layer brittle. The lower limit of the B content is preferably 0.06% by mass, more preferably 0.07% by mass. Also, the upper limit of the B content is preferably 0.15% by mass, more preferably 0.1% by mass.

(2) Optional Elements

The outer layer may further contain 0.1-3% by mass of Nb and/or 0.1-5% by mass of W. The outer layer may further contain at least one selected from the group consisting of 0.1-10% of Co, 0.01-0.5% of Zr, 0.005-0.5% of Ti, and 0.001-0.5% of Al by mass. The outer layer may further contain 0.3% or less by mass of S.

(a) Nb: 0.1-3% by Mass

Like V, Nb is combined with C to form hard MC carbides. Nb added with V and Mo is dissolved in MC carbides to strengthen them, improving the wear resistance of the outer layer. Because NbC-type MC carbide is smaller than VC-type MC carbide in specific gravity difference from the melt, the NbC-type MC carbide reduces the segregation of MC carbides. The lower limit of the Nb content is preferably 0.2% by mass. The upper limit of the Nb content is preferably 2.9% by mass, more preferably 2.8% by mass.

(b) W: 0.1-5% by Mass

W is combined with C to form hard carbides such as $M_6C$, etc., contributing to improvement in the wear resistance of the outer layer. Also, it is dissolved in MC carbides to increase their specific gravities, thereby reducing their segregation. However, when W exceeds 5% by mass, $M_6C$ carbides become excessive, resulting in a nonuniform structure which causes surface roughening. Accordingly, W is 5% or less by mass, if added. On the other hand, less than 0.1% by mass of W exhibits insufficient effects. The upper limit of the W content is preferably 4% by mass, more preferably 3% by mass.

(c) Co: 0.1-10% by Mass

Co is dissolved in the matrix, increasing the high-temperature hardness of the matrix, thereby improving the wear resistance and surface roughening resistance. Less than 0.1% by mass of Co exhibits substantially no effects, while more than 10% by mass of Co does not provide further improvement. The lower limit of the Co content is preferably 1% by mass. Also, the upper limit of the Co content is preferably 7% by mass, more preferably 6% by mass, further preferably 5% by mass, most preferably 3%.

(d) Zr: 0.01-0.5% by Mass

Like V and Nb, Zr is combined with C to form MC carbides, improving wear resistance. Also, Zr forms oxide in the melt, and this oxide acts as nuclei for crystallization, making the solidified structure finer. Further, Zr increases the specific gravity of MC carbides, preventing their segregation. To obtain this effect, the amount of Zr added is preferably 0.01% or more by mass. However, more than 0.5% by mass of Zr undesirably forms inclusions. The upper limit of the Zr content is more preferably 0.3% by mass. To obtain sufficient effects, the lower limit of the Zr content is more preferably 0.02% by mass.

(e) Ti: 0.005-0.5% by Mass

Ti is combined with C and N to form hard granular compounds such as TiC, TiN and TiCN. Because they act as nuclei for MC carbides, they are effective to achieve the uniform dispersion of MC carbides, contributing to improvement in the wear resistance and surface roughening resistance. To obtain this effect, the amount of Ti added is preferably 0.005% or more by mass. However, more than 0.5% by mass of Ti increases the viscosity of the melt, likely causing casting defects. The upper limit of the Ti content is more preferably 0.3% by mass, most preferably 0.2% by mass. To obtain sufficient effects, the lower limit of the Ti content is more preferably 0.01% by mass.

(f) Al: 0.001-0.5% by Mass

Al has high affinity for oxygen, acting as a deoxidizer. Al is also combined with N and O, and the resultant oxide, nitride, oxynitride, etc. are dispersed as nuclei in the melt, uniformly crystallizing fine MC carbides. However, more than 0.5% by mass of Al makes the outer layer brittle, while less than 0.001% by mass of Al provides insufficient effect. The upper limit of the Al content is more preferably 0.3% by mass, most preferably 0.2% by mass. To obtain sufficient effects, the lower limit of the Al content is more preferably 0.01% by mass.

(g) S: 0.3% or Less by Mass 0.3% or less by mass of S may be contained when the lubrication of MnS is utilized as described above. When S exceeds 0.3% by mass, the outer layer becomes brittle. The upper limit of the S content is preferably 0.2% by mass, more preferably 0.15% by mass. The lower limit of the S content is preferably 0.05% or more by mass.

(3) Inevitable Impurities

The balance in the composition of the outer layer is composed of substantially Fe and inevitable impurities. Among the inevitable impurities, P is preferably as little as possible because it deteriorates the mechanical properties. Specifically, the P content is preferably 0.1% or less by mass. As other inevitable impurities, elements such as Cu, Sb, Te, Ce, etc. may be contained in ranges not deteriorating the properties of the outer layer. To secure that the outer layer has excellent wear resistance and failure resistance, the total amount of the inevitable impurities is preferably 0.7% or less by mass.

(4) Structure

The structure of the outer layer is constituted by (a) MC carbides, (b) Mo-based carbides (Mo carbides) such as $M_2C$ and $M_6C$, or Cr-based carbides (Cr carbides) such as $M_7C_3$ and $M_{23}C_6$, (c) carboborides, and (d) a matrix. The carboborides generally have a composition of M(C, B), wherein M is mainly at least one metal of Fe, Cr, Mo, V, Nb and W, the percentages of the metal M, C and B varying depending on the composition. The structure of the outer layer of the present invention preferably does not contain graphite. The outer layer of the rolling composite roll of the present invention has excellent wear resistance because it contains hard MC carbides, Mo carbides or Cr carbides, and excellent sticking resistance because it contains carboborides.

(B) Inner Layer

The inner layer of the rolling composite roll of the present invention is formed by ductile cast iron having excellent toughness, which may be called "spheroidal graphite cast iron." The preferable composition of tough ductile cast iron comprises by mass 2.5-4% of C, 1.5-3.1% of Si, 0.2-1% of Mn, 0.4-5% of Ni, 0.01-1.5% of Cr, 0.1-1% of Mo, 0.02-0.08% of Mg, 0.1% or less of P, and 0.1% or less of S, the balance being substantially Fe and inevitable impurities. Using ductile cast iron for the inner layer, it is possible to prevent the composite roll from being damaged by a rolling load in finishing stands.

(C) Intermediate Layer

The composite roll of the present invention has a centrifugally cast intermediate layer of an Fe-based alloy in a boundary between the outer layer and the inner layer, to suppress the mixing of components between both layers. The intermediate layer has a similar composition to that of the outer layer. To avoid shrinkage voids from being generated near a boundary between the outer layer and the inner layer, and increase the bonding of the outer layer to the inner layer, the intermediate layer has the following characteristics:

(a) The intermediate layer contains 0.025-0.15% by mass of B, (b) The B content in the intermediate layer is 40-80% of that in the outer layer, and (c) The total amount of carbide-forming elements in the intermediate layer is 40-90% of that in the outer layer.

In the outer layer containing 0.05-0.2% by mass of B, carboborides are formed. The solidification completion temperature decreases because of carboborides having lower melting points. When an intermediate layer melt cast onto the inner surface of the outer layer has too higher a solidification completion temperature than that of the outer layer melt, shrinkage voids are likely generated near their boundary because the solidification of the outer layer is completed sooner than the solidification of the intermediate layer. To prevent shrinkage voids from being generated near their boundary by making the solidification completion of the intermediate layer later than the solidification completion of the outer layer by reducing the solidification completion time of the intermediate layer, the present invention prescribes that the B content in the intermediate layer is 40-80% of the B content in the outer layer, and that the B content in the intermediate layer is 0.025-0.15% by mass. When the B content in the intermediate layer exceeds 0.15% by mass, excessive B is mixed into the inner layer when the inner layer of ductile cast iron is bonded to the intermediate layer, hindering the graphitization of the ductile cast iron, and thus making the inner layer brittle. When the B content in the intermediate layer exceeds 80% of that in the outer layer, the effect of preventing defects near the boundary between the outer layer and the intermediate layer is saturated. To avoid excessive B hindering the graphitization of the inner layer from being mixed into the inner layer, the B content in the intermediate layer is at most 80% of that in the outer layer.

The lower limit of the B content in the intermediate layer is preferably 0.027% by mass, more preferably 0.028% by mass. The upper limit of the B content in the intermediate layer is preferably 0.1% by mass, more preferably 0.06% by mass. The B content in the intermediate layer is preferably 45% or more, more preferably 50% or more, of that in the outer layer. Also, the B content in the intermediate layer is preferably 75% or less, more preferably 70% or less, of that in the outer layer.

The total amount of carbide-forming elements in the intermediate layer is 40-90% of the total amount of carbide-forming elements in the outer layer. In the present invention, the carbide-forming elements in the outer and intermediate layers are Cr, Mo, V, Nb and W. Though the carbide-forming elements are less influential than B on the solidification completion temperature of the intermediate layer, there is large solidification completion temperature difference between the outer layer and the intermediate layer when the total amount of the carbide-forming elements in the intermediate layer is less than 40% of that in the outer layer, resulting in discontinuous solidification in and near the boundary, and thus likely generating shrinkage voids. On the other hand, when the total amount of the carbide-forming elements in the intermediate layer is more than 90% of that in the outer layer, large amounts of these elements are mixed into the inner layer of ductile cast iron, hindering the graphitization of ductile cast iron, and thus reducing the strength of the inner layer. The total amount of carbide-forming elements in the intermediate layer is preferably 45% or more of that in the outer layer. Also, the total amount of carbide-forming elements in the intermediate layer is preferably 70% or less, more preferably 60% or less, of that in the outer layer.

With respect to each of the carbide-forming elements, its intermediate layer/outer layer ratio is preferably 40-100%. Namely, the amount of each of Cr, Mo, V, Nb and W in the intermediate layer is preferably 40-100% of the amount of each of Cr, Mo, V, Nb and W in the outer layer. When the amount of each of Cr, Mo, V, Nb and W in the intermediate layer is less than 40% of that in the outer layer, the total amount of carbide-forming elements in the intermediate layer is likely to be less than 40% of that in the outer layer. On the other hand, when the amount of each of Cr, Mo, V, Nb and W in the intermediate layer exceeds 100% of that in the outer layer, the total amount of carbide-forming elements in the intermediate layer is likely to exceed 90% of that in the outer layer. Even if any one of carbide-forming elements in the intermediate layer is 100% of that of the carbide-forming elements in the outer layer, the solidification completion temperature difference between the outer layer and the intermediate layer can be made small, as long as the condition that the total amount of the carbide-forming elements in the intermediate layer is 90% or less of that in the outer layer is met.

The preferred composition of the intermediate layer meeting the above conditions comprises by mass 1.5-3.5% of C, 0.3-3.0% of Si, 0.1-2.5% of Mn, 0.1-5% of Ni, 0.4-7% of Cr, 0.4-6% of Mo, 0.15-5% of V, and 0.025-0.15% of B, which is 40-80% of B in the outer layer, the balance being Fe and inevitable impurities, the total amount of the carbide-forming elements being 40-90% of that in the outer layer. The intermediate layer may further contain 0-2.5% by mass of Nb and/or 0-4% by mass of W. The above composition of the intermediate layer is measured with attention paid to a particular element (B), as described below.

Figure 2:
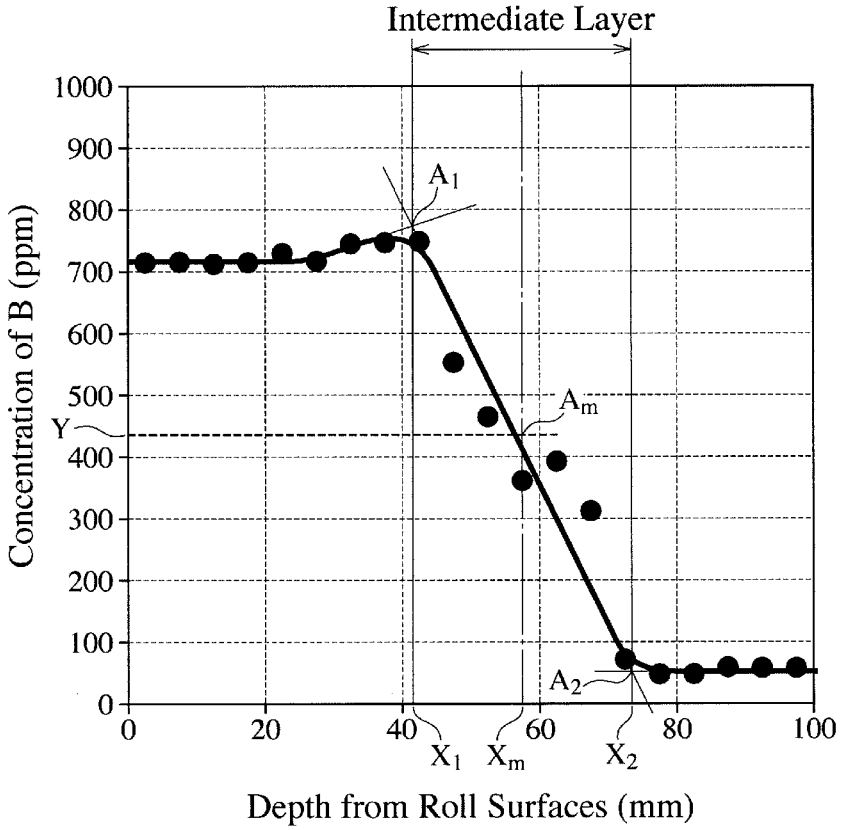
FIG. 2 is a graph showing a concentration distribution of B in a region from the outer layer to the inner layer.

Because the intermediate layer is integrally fused to the outer layer and the inner layer, its boundaries with the outer and inner layers are not clear. Thus, attention is paid to a particular element (B), and specimens for analysis are taken at an interval of 2-5 mm from a region expanding from the outer layer to the inner layer, to measure the concentration of B by ICP (inductively coupled plasma) optical emission spectrometry. FIG. 2 is a graph in which the concentration of B is plotted against the depth from the roll surface. As is clear from FIG. 2, the concentration distribution of B has inflection points A1, A2 in boundary regions between the outer layer and the intermediate layer, and between the intermediate layer and the inner layer, respectively. The intermediate layer is between both inflection points A1, A2, and the concentration of B in the intermediate layer is determined at the midpoint Am between both inflection points A1, A2.

The intermediate layer is preferably as thick as 10-30 mm. Because the intermediate layer effectively reduces solidification completion temperature change from the outer layer containing hard carbides to the inner layer of ductile cast iron, the intermediate layer preferably has a thickness of at least 10 mm. The intermediate layer of less than 10 mm is insufficient in reducing solidification completion temperature change, likely failing to prevent defects surely. On the other hand, because the intermediate layer containing large amounts of carbide-forming elements is more brittle than the inner layer of ductile cast iron, too thick an intermediate layer would reduce the percentage of the inner layer, resulting in increased likelihood of roll breakage, etc. Accordingly, the thickness of the intermediate layer is preferably 30 mm or less. The lower limit of the thickness of the intermediate layer is more preferably 12 mm, further preferably 15 mm. The upper limit of the thickness of the intermediate layer is more preferably 28 mm, further preferably 25 mm.

[2] Production Method of Rolling Composite Roll

The centrifugally cast composite roll for hot rolling according to the present invention is produced by (1) centrifugally casting an outer layer melt prepared to provide the above outer layer composition in a rotating cylindrical centrifugal-casting mold; (2) pouring an intermediate layer melt at a temperature equal to or higher than the solidification start temperature of the intermediate layer +110° C. into a cavity of the outer layer, while the inner surface temperature of the outer layer is the solidification temperature of the outer layer or higher, to form the intermediate layer by centrifugal casting; (3) with the cylindrical casting mold comprising the outer layer and the intermediate layer erected after the solidification of the intermediate layer, attaching upper and lower molds to upper and lower ends of the cylindrical casting mold to constitute a static casting mold; and (4) pouring a ductile cast iron melt for an inner layer into a hollow portion (cavity) defined by the upper mold, the cylindrical casting mold comprising the outer and intermediate layers and the lower mold. Incidentally, the cylindrical casting mold for forming the outer and intermediate layers, and the upper and lower molds for forming the inner layer may be integrated in advance as a static casting mold.

(A) Formation of Outer Layer (1) Casting Temperature

The casting temperature of a melt for the outer layer is preferably in a range from Ts+30° C. to Ts+150° C., wherein Ts is an austenite crystallization start temperature. When the casting temperature is lower than Ts+30° C., the solidification of a cast melt is too slow, so that harmful materials such as fine inclusions, etc. solidified before separation due to a centrifugal force tend to remain as harmful defects. On the other hand, when the casting temperature is higher than Ts+150° C., eutectic-carbide-concentrated, laminar regions are formed. The lower limit of the casting temperature is more preferably Ts+50° C. The upper limit of the casting temperature is more preferably Ts+120° C. Incidentally, the austenite crystallization start temperature Ts is the start temperature of heat generation by solidification, which is measured by a differential thermal analyzer. Because the melt for the outer layer is usually poured into a centrifugal-casting mold through a route from a ladle to a funnel, a melt-pouring nozzle, etc., or through a route from a tundish to a melt-pouring nozzle, etc., the casting temperature mentioned herein is the temperature of a melt in the ladle or tundish.

(2) Centrifugal Force

When the outer layer is cast by a centrifugal-casting mold, a centrifugal force is in a range of 60-200 G by the number of times of gravity. With less than 60 G of the number of times of gravity, the outer layer melt is not sufficiently attached to an inner surface of the casting mold. On the other hand, when the number of times of gravity exceeds 200 G, extreme centrifugal separation occurs, resulting in large segregation. The number of times of gravity (G No.) is expressed by the formula of G No.=N×N×D/1,790,000, wherein N is the number of revolution (rpm) of the mold, and D is the inner diameter (mm) of the mold (corresponding to the outer diameter of the outer layer).

(3) Centrifugal-Casting Mold

Figure 3A:
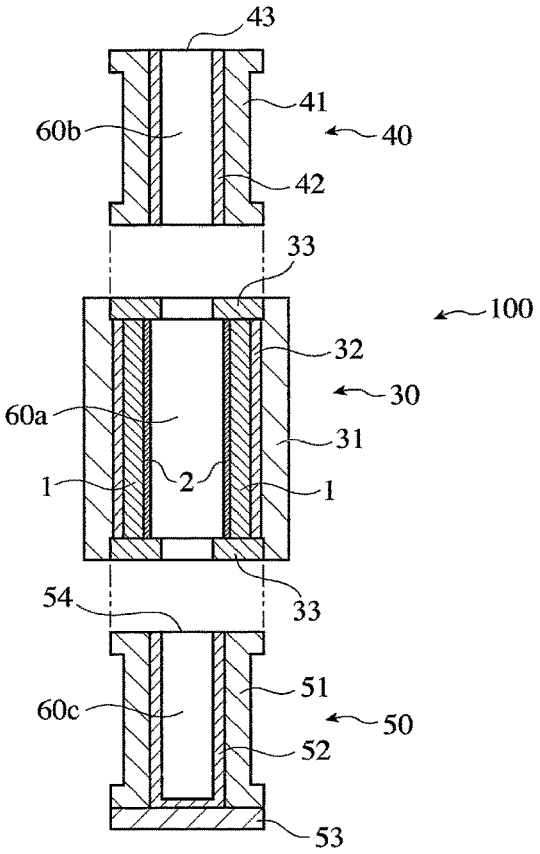
FIG. 3(*a*) is an exploded cross-sectional view showing an example of casting molds used for producing the rolling composite roll of the present invention.
Figure 3B:
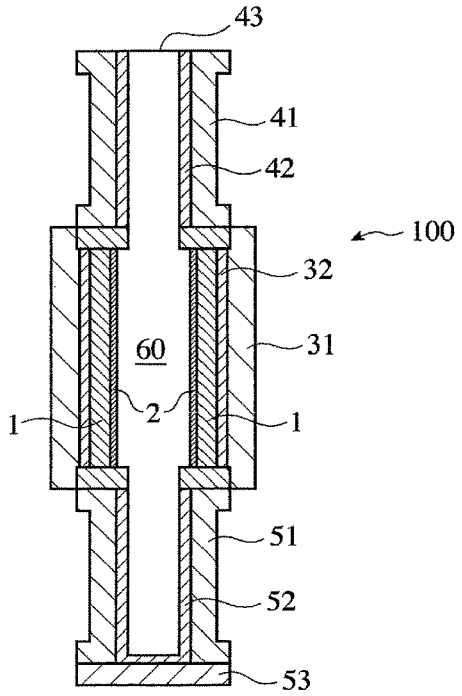

As shown in FIG. 3(*a*), a cylindrical casting mold 30 for centrifugally casting the outer layer 1 and the intermediate layer 2 comprises a cylindrical die 31, a facing material layer 32 formed on an inner surface of the cylindrical die 31, and sand mold portions 33 attached to upper and lower openings of the cylindrical die 31, and a hollow portion inside the intermediate layer 2 in the cylindrical casting mold 30 acts as a cavity 60 for forming the inner layer 2. Centrifugal casting may be horizontal, inclined or vertical.

(4) Facing Material

To prevent the seizure of the outer layer 1 to the cylindrical die 31, a facing material based on silica, alumina, magnesia or zircon is preferably coated on an inner surface of the cylindrical die 31 to form a facing material layer 32 as thick as 0.5-5 mm. A facing material layer 32 thicker than 5 mm makes the cooling of a melt too slow, so that a liquid phase remains too long, tending to cause segregation by centrifugal separation. On the other hand, a facing material layer 32 thinner than 0.5 mm insufficiently prevents the sticking of the outer layer 1 to the cylindrical die 31. The more preferred thickness of the facing material layer 32 is 0.5-4 mm.

(B) Formation of Intermediate Layer

While the inner surface temperature of the cast outer layer 1 is equal to or higher than the solidification completion temperature of the outer layer 1, a melt for an intermediate layer at a temperature equal to or higher than the solidification start temperature of the intermediate layer+110° C. is cast into a cavity of the outer layer. Because the intermediate layer melt in a molten state (at the solidification start temperature+110° C. or higher) is cast while the inner surface of the outer layer 1 is not completely solidified, they are solidified with mutual diffusion, forming an intermediate layer 2 meeting the conditions that (a) the intermediate layer 2 contains 0.025-0.15% by mass of B, that (b) the B content in the intermediate layer 2 is 40-80% of the B content in the outer layer 1, and that (c) the total amount of carbide-forming elements in the intermediate layer 2 is 40-90% of the total amount of carbide-forming elements in the outer layer 1. Thus, the intermediate layer 2 is integrally fused to the outer layer 1 without shrinkage voids in the boundary.

When the inner surface temperature of the cast outer layer 1 is lower than the solidification completion temperature of the outer layer 1, the inner surface of the outer layer is not sufficiently remelted by heat from the intermediate layer melt, resulting in insufficient diffusion between the outer layer 1 and the inner layer 2, and thus failing to obtain the intermediate layer meeting the above conditions. Also, when the temperature of the intermediate layer melt is lower than the solidification start temperature+110° C., the inner surface of the outer layer is likewise not sufficiently remelted by heat from the intermediate layer melt, resulting in insufficient diffusion between the outer layer 1 and the inner layer 2, and thus failing to obtain the intermediate layer meeting the above conditions. When the inner surface temperature of the outer layer 1 is lower than the solidification completion temperature of the outer layer 1+250° C., the outer layer is not excessively melted, preferably securing the predetermined thickness of the outer layer. Also, when the casting temperature of the intermediate layer melt is equal to or lower than the solidification start temperature+280° C., the outer layer is not excessively melted, preferably securing the predetermined thickness of the outer layer. The casting temperature of the intermediate layer melt is preferably equal to or higher than the solidification start temperature+120° C. The casting temperature of the intermediate layer melt is more preferably equal to or lower than the solidification start temperature+250° C.

The solidification completion temperature of the outer layer melt is a temperature at which the outer layer 1 becomes a completely solid phase, corresponding to the solidification temperature of portions having the lowest melting point among those constituting the outer layer 1 (for example, carboborides). Also, the solidification start temperature of the intermediate layer is a temperature at which primary crystals (for example, primary austenite) are formed in the intermediate layer melt. The solidification completion temperatures of melts for the outer and intermediate layers can be measured by a differential thermal analyzer.

The preferred composition of the intermediate layer melt comprises by mass 1.5-3.7% of C, 0.3-3.0% of Si, 0.1-2.5% of Mn, 0.1-2.0% of Ni, 0.1-5.0% of Cr, 0-2.0% of Mo, 0-2.0% of V, and 0-0.1% of B, the balance being Fe and inevitable impurities. The intermediate layer melt may contain 0-1.0% by mass of Nb and/or 0-2.0% by mass of W.

(C) Formation of Inner Layer

As shown in FIGS. 3(*a*) and 3(*b*), a static casting mold 100 comprises the cylindrical, centrifugal-casting mold 30 comprising the outer layer 1 and the intermediate layer 2, and an upper mold 40 and a lower mold 50 attached to upper and lower ends of the cylindrical, centrifugal-casting mold 30. The upper mold 40 comprises a cylindrical die 41 and a sand mold 42 formed inside the cylindrical die 41, and the lower mold 50 comprises a cylindrical die 51 and a sand mold 52 formed inside the cylindrical die 51. The upper mold 40 has a cavity 60*b* for forming one end portion of the inner layer 2, and the lower mold 50 has a cavity 60*c* for forming the other end of the inner layer 2. The lower mold 50 is provided with a bottom plate 53 for holding the inner layer melt.

The cylindrical casting mold 30 comprising the centrifugally cast outer and intermediate layers 1, 2 is vertically mounted onto the lower mold 50, and the upper mold 40 is mounted onto the cylindrical casting mold 30 to constitute the static casting mold 100 for forming the inner layer 2. Thus, the cavity 60*a* of the intermediate layer 2 communicates with the cavity 60*b* of the upper mold 40 and the cavity 60*c* of the lower mold 50, constituting a cavity 60 for integrally forming the entire inner layer 3.

A ductile cast iron melt for the inner layer 3 is poured into the cavity 60 through an upper opening 43 of the upper mold 40. The preferred composition of the ductile cast iron melt comprises by mass 2.5-4% of C, 1.5-3.1% of Si, 0.2-1% of Mn, 0.4-5% of Ni, 0.01-1.5% of Cr, 0.1-1% of Mo, 0.02-0.08% of Mg, 0.1% or less of P, and 0.1% or less of S, the balance being substantially Fe and inevitable impurities. Because the inner layer 3 is solidified after the inner surface of the intermediate layer 2 is remelted, they are well integrally fused (metallurgically bonded) to each other.

Because the mutual diffusion of elements occurs in boundaries between the outer layer and the intermediate layer, and between the intermediate layer and the inner layer as shown in FIG. 2, the composition of the solidified intermediate layer differs from the composition of its melt, exhibiting gradient from the outer layer to the inner layer.

(D) Heat Treatment

After the inner layer 3 is cast, a hardening treatment is conducted if necessary, and a tempering treatment is conducted one or more times. The tempering temperature is preferably 480-580° C.

The present invention will be explained in further detail by Examples below, without intention of restricting the present invention thereto.

Examples 1-3

(1) Production of Composite Roll

Each outer layer melt having the composition (balance: Fe and inevitable impurities) shown in Table 1 was centrifugally cast in a cylindrical centrifugal-casting mold 30 of 650 mm in inner diameter and 3000 mm in length, which was rotating at a high speed. The solidification completion temperatures of the outer layer melts having the above compositions are shown in Table 2. When the inner surface temperature of the outer layer (surface temperature of a flux layer) was 1200° C. before the solidification completion of the inner surface of the outer layer, each intermediate layer melt having the composition (balance: Fe and inevitable impurities) shown in Table 1 was centrifugally cast at the temperature shown in Table 2 in the cavity 60*a* of the outer layer. The solidification start temperatures of the intermediate layer melts having the above compositions are also shown in Table 2.

After a hollow intermediate layer was solidified, the rotation of the cylindrical centrifugal-casting mold 30 was stopped, and an upper mold 40 (length: 2000 mm) and a lower mold 50 (length: 1500 mm) were attached to upper and lower ends of the cylindrical casting mold 30 to constitute a static casting mold 100. Each ductile cast iron melt for the inner layer having the composition (balance: Fe and inevitable impurities) shown in Table 1 was stationarily cast at 1423° C. in a cavity 60 of this static casting mold 100. After the solidification completion of the inner layer, the static casting mold 100 was disassembled to take out the cast composite roll, which was tempered at 525° C. for 10 hours.

The ultrasonic testing of the composite rolls confirmed that there were no shrinkage voids in boundaries between the outer layer, the intermediate layer and the inner layer.

Test pieces for analysis were taken out from a region from the outer layer to the inner layer at intervals of 5 mm, and the concentration of B was measured by inductively coupled plasma (ICP) optical emission spectrometry to determine the concentration distribution of B. The concentrations of component elements (C, Si, Mn, Ni, Cr, Mo, V, Nb, W and B) were measured at a midpoint Am between the inflection points A1, A2 of the concentration distribution of B, as the concentrations of the component elements in the intermediate layer. Also, the concentrations of the component elements (C, Si, Mn, Ni, Cr, Mo, V, Nb, W and B) were measured at a center of a usable region of the outer layer ranging from the outer layer surface to the discard diameter, as the concentrations of the component elements in the outer layer. The average thicknesses of the outer layer and the hollow intermediate layer, which were determined based on the concentration distribution of B, were 65 mm and 22 mm, respectively.

Comparative Example 1

A composite roll was produced in the same manner as in Example 1, except that (a) a melt for the outer layer, a melt for the intermediate layer, and a ductile cast iron melt for the inner layer each having the composition shown in Table 1 were used, and that (b) the inner surface temperature of the outer layer was 1080° C. when the intermediate layer melt was cast, and the casting temperature of the intermediate layer melt was 1560° C. The concentrations of component elements in the outer and intermediate layers were measured by the same method as in Example 1. Ultrasonic testing revealed that there were shrinkage voids in a boundary between the outer layer and the intermediate layer.

Comparative Example 2

A composite roll was produced in the same manner as in Example 1, except that (a) a melt for the outer layer, a melt for the intermediate layer, and a ductile cast iron melt for the inner layer each having the composition shown in Table 1 were used, and that (b) the casting temperature of the intermediate layer melt was 1400° C. The concentrations of component elements in the outer and intermediate layers were measured by the same method as in Example 1. Ultrasonic testing revealed that there were shrinkage voids in a boundary between the outer layer and the intermediate layer.

With respect to Examples 1-3, and Comparative Examples 1 and 2, the concentrations of component elements in the outer and intermediate layers are shown in Table 1, and the production conditions of the composite rolls, B content ratios between the intermediate layer and the outer layer, and the total amount ratios of Cr, Mo, V, Nb and W, and the presence of defects in a boundary between the outer layer and the intermediate layer are shown in Table 2.

TABLE 1

| No. | | | Composition (% by mass) | | | | | |
|---|---|---|---|---|---|---|---|---|
| | | | C | Si | Mn | Ni | Cr | Mo |
| Example 1 | Outer Layer | After Solidification | 1.89 | 0.84 | 0.70 | 2.22 | 4.63 | 4.88 |
| | Intermediate | Melt | 2.51 | 0.86 | 0.41 | 0.23 | 0.32 | 0.04 |
| | Layer | After Solidification | 2.20 | 0.81 | 0.55 | 1.37 | 2.16 | 2.58 |
| | Inner Layer | Melt | 3.11 | 2.54 | 0.35 | 0.39 | 0.13 | 0.04 |
| Example 2 | Outer Layer | After Solidification | 1.82 | 0.81 | 0.65 | 2.23 | 4.48 | 5.88 |
| | Intermediate | Melt | 2.49 | 0.84 | 0.40 | 0.25 | 0.28 | 0.02 |
| | Layer | After Solidification | 2.15 | 0.80 | 0.52 | 1.31 | 2.14 | 2.86 |
| | Inner Layer | Melt | 3.29 | 2.53 | 0.47 | 0.52 | 0.1 | 0.03 |
| Example 3 | Outer Layer | After Solidification | 1.81 | 0.78 | 0.39 | 1.75 | 4.91 | 4.66 |
| | Intermediate | Melt | 2.12 | 0.88 | 0.40 | 3.54 | 0.57 | 0.03 |
| | Layer | After Solidification | 2.04 | 0.79 | 0.36 | 2.76 | 2.47 | 2.13 |
| | Inner Layer | Melt | 3.01 | 2.48 | 0.46 | 0.42 | 0.10 | 0.02 |

TABLE 1-continued

| | | | | | | | | |
|---|---|---|---|---|---|---|---|---|
| Com. Ex. 1 | Outer Layer | After Solidification | 1.87 | 0.77 | 0.72 | 2.30 | 4.87 | 4.84 |
| | Intermediate | Melt | 2.51 | 0.81 | 0.39 | 0.24 | 0.31 | 0.03 |
| | Layer | After Solidification | 2.41 | 0.76 | 0.42 | 0.53 | 1.33 | 0.98 |
| | Inner Layer | Melt | 3.09 | 2.49 | 0.41 | 0.37 | 0.11 | 0.03 |
| Com. Ex. 2 | Outer Layer | After Solidification | 1.92 | 0.77 | 0.72 | 2.34 | 4.75 | 4.79 |
| | Intermediate | Melt | 2.49 | 0.84 | 0.40 | 0.25 | 0.28 | 0.02 |
| | Layer | After Solidification | 2.41 | 0.80 | 0.42 | 0.41 | 1.01 | 1.07 |
| | Inner Layer | Melt | 3.09 | 2.49 | 0.41 | 0.37 | 0.11 | 0.03 |

| | No. | | Composition (% by mass) | | | | | |
|---|---|---|---|---|---|---|---|---|
| | | | V | Nb | W | N | B | Fe[1] |
| Example 1 | Outer Layer | After Solidification | 4.85 | 0.43 | 0.45 | 0.06 | 0.08 | Bal. |
| | Intermediate | Melt | 0.02 | 0.00 | 0.00 | 0.01 | 0.01 | Bal. |
| | Layer | After Solidification | 2.11 | 0.18 | 0.19 | 0.01 | 0.04 | Bal. |
| | Inner Layer | Melt | 0.018 | 0.002 | 0.003 | 0.005 | 0.005 | Bal. |
| Example 2 | Outer Layer | After Solidification | 4.61 | 0.41 | 0.51 | 0.05 | 0.08 | Bal. |
| | Intermediate | Melt | 0.03 | 0.00 | 0.00 | 0.01 | 0.01 | Bal. |
| | Layer | After Solidification | 2.06 | 0.19 | 0.23 | 0.01 | 0.05 | Bal. |
| | Inner Layer | Melt | 0.028 | 0.004 | 0.005 | 0.005 | 0.0012 | Bal. |
| Example 3 | Outer Layer | After Solidification | 4.34 | 0.51 | 0.49 | 0.04 | 0.08 | Bal. |
| | Intermediate | Melt | 0.02 | 0.00 | 0.00 | 0.01 | 0.01 | bal. |
| | Layer | After Solidification | 2.17 | 0.24 | 0.23 | 0.01 | 0.034 | Bal. |
| | Inner Layer | Melt | 0.014 | 0.002 | 0.002 | 0.004 | 0.002 | Bal. |
| Com. Ex. 1 | Outer Layer | After Solidification | 4.86 | 0.42 | 0.45 | 0.06 | 0.08 | Bal. |
| | Intermediate | Melt | 0.02 | 0.00 | 0.00 | 0.01 | 0.01 | Bal. |
| | Layer | After Solidification | 1.12 | 0.08 | 0.09 | 0.01 | 0.02 | Bal. |
| | Inner Layer | Melt | 0.021 | 0.003 | 0.004 | 0.005 | 0.004 | Bal. |
| Com. Ex. 2 | Outer Layer | After Solidification | 4.88 | 0.49 | 0.48 | 0.06 | 0.08 | Bal. |
| | Intermediate | Melt | 0.03 | 0.00 | 0.00 | 0.01 | 0.01 | Bal. |
| | Layer | After Solidification | 0.99 | 0.10 | 0.08 | 0.01 | 0.02 | Bal. |
| | Inner Layer | Melt | 0.021 | 0.003 | 0.004 | 0.006 | 0.004 | Bal. |

Note:
[1]The balance included inevitable impurities.

TABLE 2

| | Intermediate Layer/Outer Layer Ratio (%) | | Outer Layer | | Intermediate Layer | | Defects in Outer Layer/ |
|---|---|---|---|---|---|---|---|
| No. | B [1] | Carbide-Forming Elements [2] | Solidification Completion Temp. (° C.) | Inner Surface Temp. (° C.) [3] | Solidification Start Temp. (° C.) | Casting Temp. (° C.) | Intermediate Layer Boundary [4] |
| Example 1 | 50 | 47.4 | 1103 | 1200 | 1304 | 1525 | No [5] |
| Example 2 | 63 | 47.1 | 1096 | 1200 | 1295 | 1512 | No |
| Example 3 | 43 | 48.6 | 1109 | 1200 | 1322 | 1451 | No |
| Com. Ex. 1 | 25 | 23.3 | 1101 | 1080 | 1302 | 1560 | Yes [6] |
| Com. Ex. 2 | 25 | 21.1 | 1105 | 1200 | 1300 | 1400 | Yes |

Note:
[1] A ratio (%) of the B content in the intermediate layer to the B content in the outer layer.
[2] A ratio (%) of the total amount of Cr, Mo, V, Nb and W in the intermediate layer to the total amount of Cr, Mo, V, Nb and W in the outer layer.
[3] The inner surface temperature of the outer layer when the intermediate layer melt was cast.
[4] Shrinkage voids.
[5] There were no defects.
[6] There were defects.

As is clear from Table 1, in Examples 1-3, the B content in the solidified intermediate layer was as high as 0.04% by mass (Example 1), 0.05% by mass (Example 2), and 0.034% by mass (Example 3), respectively, even with the B content of 0.01% by mass in the intermediate layer melt, and the total amount of Cr, Mo, V, Nb and W in the solidified intermediate layer was as high as 7.22% by mass (Example 1), 7.48% by mass (Example 2), and 7.24% by mass (Example 3), respectively, even if the total amount of Cr, Mo, V, Nb and W in the intermediate layer melt was 0.38% by mass (Example 1), 0.33% by mass (Example 2), and 0.62% by mass (Example 3), respectively. As a result, any composite roll of Examples 1-3 met the conditions that (a) the intermediate layer contained 0.025-0.15% by mass of B, that (b) the B content in the intermediate layer was 40-80% of that in the outer layer, and that (c) the total amount of Cr, Mo, V, Nb and W in the intermediate layer was 40-90% of that in the outer layer. This is due to the fact that while the inner surface temperature of the outer layer was equal to or higher than the solidification completion temperature of the outer layer melt, the intermediate layer melt at a temperature equal to or higher than the solidification start temperature of the intermediate layer+110° C. was cast into a cavity of the outer layer, so that the inner surface of the outer layer was properly remelted to permit B, Cr, Mo, V, Nb and W in the outer layer to be mixed into the intermediate layer melt, meaning that the outer layer was well integrally fused (metallurgically bonded) to the intermediate layer. Accordingly, any composite roll of Examples 1-3 was free from defects such as shrinkage voids, etc. in a boundary between the outer layer and the intermediate layer.

In the solidified intermediate layer in Comparative Examples 1 and 2, the amount of B was as small as 0.02% by mass, and the total amount of Cr, Mo, V, Nb and W was as small as 3.60% by mass (Comparative Example 1) and 3.25% by mass (Comparative Example 2), even though substantially the same intermediate layer melts as in Examples 1-3 were used. Accordingly, the B content in the intermediate layer was 25.0% (Comparative Examples 1 and 2) of that in the outer layer, and the total amount of Cr, Mo, V, Nb and W in the intermediate layer was 23.3% (Comparative Example 1) and 21.1% (Comparative Example 2) of that in the outer layer, both failing to meet the above requirements (a) to (c). In Comparative Example 1, because the intermediate layer melt was cast when the inner surface temperature of the outer layer became lower than the solidification completion temperature of the outer layer melt, the inner surface of the outer layer was not properly remelted, so that B, Cr, Mo, V, Nb and W in the outer layer were not sufficiently mixed into the intermediate layer melt. In Comparative Example 2, because the casting temperature of the intermediate layer melt was lower than the solidification start temperature of the intermediate layer melt+110° C., the inner surface of the outer layer was not properly remelted, so that B, Cr, Mo, V, Nb and W in the outer layer were not sufficiently mixed into the intermediate layer melt. Accordingly, in Comparative Examples 1 and 2, the outer layer and the intermediate layer were not well integrally fused (metallurgically bonded) to each other, resulting in shrinkage voids in a boundary between the outer layer and the intermediate layer.

Figure 4:
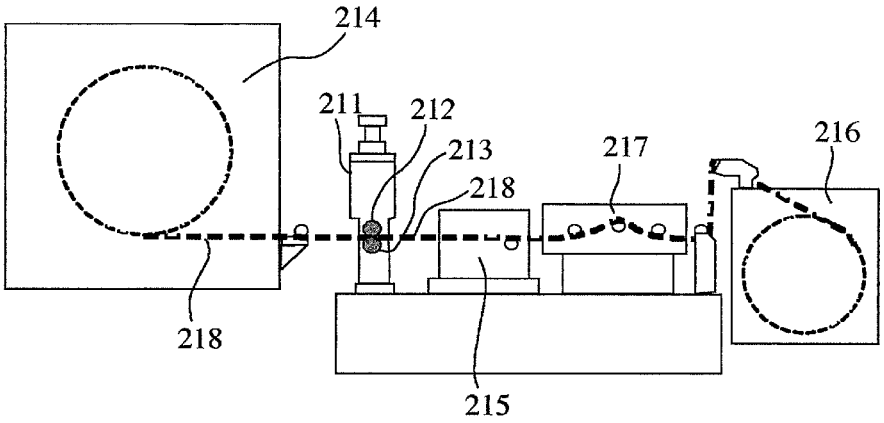
FIG. 4 is a schematic view showing a rolling test mill for wear evaluation.

A sleeve-shaped test roll of 60 mm in outer diameter, 40 mm in inner diameter and 40 mm in width was cut out of the outer layer of the composite roll produced in Examples 1-3, and Comparative Examples 1 and 2, and evaluated with respect to wear resistance using a wearing-by-rolling test machine 200 shown in FIG. 4. The rolling test mill 200 for wear evaluation comprises a rolling mill 211, test rolls 212, 213 assembled in the rolling mill 211, a heating furnace 214 for preheating a strip 218 to be rolled, a cooling water bath 215 for cooling a rolled strip 218, a winding machine 216 for giving tension to the strip during rolling, and a controller 217 for adjusting the tension. A wearing test (rolling) was conducted under the following rolling conditions for wear evaluation. After rolling, the depth of wear on the test roll surface was measured by a stylus-type surface roughness meter, to evaluate the wear resistance of each test roll. It was found that all samples of Examples 1-3, and Comparative Examples 1 and 2 had good wear resistance, which was acceptable for practical use.

Strip to be rolled: SUS304,
Reduction ratio: 25%,
Rolling speed: 150 m/minute,
Temperature of strip to be rolled: 900° C.,
Rolling length: 300 m per each rolling,
Roll cooling: cooling with water, and
Number of rolls: 4 Hi.

Figure 5:
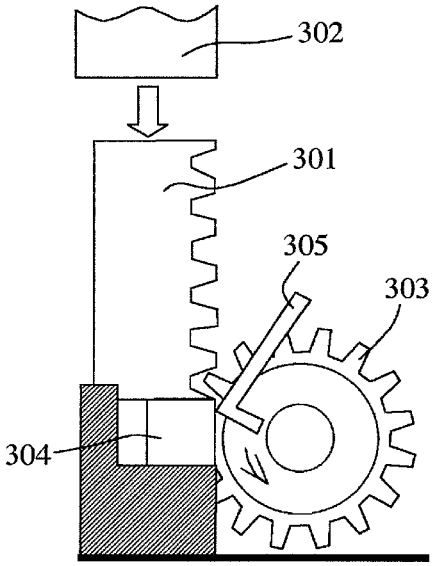
FIG. 5 is a schematic view showing a test machine for evaluating thermal shock by friction.

A test piece (30 mm×25 mm×25 mm) was cut out of the outer layer of each composite roll produced in Examples 1-3, and Comparative Examples 1 and 2, to evaluate its sticking resistance using a friction heat shock test machine 300 shown in FIG. 5. In the friction heat shock test machine 300, a weight 302 is dropped onto a rack 301 to rotate a pinion 303, so that a member 305 to be bitten is brought into strong contact with a test piece 304. Evaluation by the area ratio of sticking revealed that substantially no sticking was observed in all test pieces of Examples 1-3, and Comparative Example 1 and 2, acceptable for practical use.

What is claimed is:

1. A composite roll for rolling having a structure comprising centrifugally cast outer and intermediate layers both made of an Fe-based alloy, and an inner layer of ductile cast iron, said layers being integrally fused to each other;

said outer layer having a composition comprising by mass 1-3% of C, 0.3-3% of Si, 0.1-3% of Mn, 0.5-5% of Ni, 1-7% of Cr, 2.2-8% of Mo, 4-7% of V, 0.005-0.15% of N, and 0.05-0.2% of B, the balance being Fe and inevitable impurities;

said intermediate layer containing 0.025-0.15% by mass of B;

the B content in said intermediate layer being 40-80% of the B content in said outer layer; and the total amount of carbide-forming elements in said intermediate layer being 45-90% of the total amount of carbide-forming elements in said outer layer.

2. The composite roll for rolling according to claim 1, wherein said outer layer further contains 0.1-3% by mass of Nb and/or 0.1-5% by mass of W.

3. The composite roll for rolling according to claim 1, wherein said outer layer further contains at least one selected from the group consisting of 0.1-10% of Co, 0.01-0.5% of Zr, 0.005-0.5% of Ti, and 0.001-0.5% of Al by mass.

4. A method for producing the composite roll for rolling recited in claim 1, comprising (1) centrifugally casting said outer layer in a rotating cylindrical centrifugal-casting mold;

(2) while the inner surface temperature of said outer layer is equal to or higher than the solidification completion temperature of the outer layer melt, pouring a melt for the intermediate layer at a temperature equal to or higher than the solidification start temperature of the intermediate layer+110° C. into a cavity of said outer layer, to centrifugally cast said intermediate layer; and (3) after the solidification of said intermediate layer, casting a ductile cast iron melt for said inner layer into a cavity of said intermediate layer to form said inner layer.

* * * * *